US005579433A

United States Patent [19]

Jarvinen

[11] Patent Number: 5,579,433

[45] Date of Patent: Nov. 26, 1996

[54] DIGITAL CODING OF SPEECH SIGNALS USING ANALYSIS FILTERING AND SYNTHESIS FILTERING

[75] Inventor: Kari J. Jarvinen, Tampere, Finland

[73] Assignee: Nokia Mobile Phones, Ltd., Salo, Finland

[21] Appl. No.: 60,427

[22] Filed: May 7, 1993

[30] Foreign Application Priority Data

May 11, 1992 [FI] Finland ..... 922128

[51] Int. Cl.[6] ..... G10L 3/02; G10L 9/00; G10L 5/00; G10L 7/00

[52] U.S. Cl. ..... 395/228; 395/2.29; 395/2.31; 395/2.32; 395/2.77

[58] Field of Search ..... 395/2.28, 2.29, 395/2.3, 2.31, 2.32, 2.39, 2.71

[56] References Cited

U.S. PATENT DOCUMENTS

| | | | |
|---|---|---|---|
| 4,932,061 | 6/1990 | Kroon et al. | 381/30 |
| 5,086,471 | 2/1992 | Tanaka et al. | 381/36 |
| 5,271,089 | 12/1993 | Ozawa | 395/2.31 |
| 5,295,224 | 3/1994 | Makamura et al. | 395/2.32 |

FOREIGN PATENT DOCUMENTS

| | | | |
|---|---|---|---|
| 0259950 | 3/1988 | European Pat. Off. | G10L 9/14 |
| 0422232 | 4/1989 | European Pat. Off. | G10L 9/14 |
| 0375551 | 6/1990 | European Pat. Off. | G10L 9/14 |
| 0415163A2 | 3/1991 | European Pat. Off. | G10L 9/14 |
| 0422232A1 | 4/1991 | European Pat. Off. | G10L 9/14 |
| 922128 | 5/1992 | Finland . | |
| 2204766 | 5/1988 | United Kingdom | G10L 9/00 |

*Primary Examiner*—Allen R. MacDonald
*Assistant Examiner*—Indranil Chowdhury
*Attorney, Agent, or Firm*—Perman & Green

[57] ABSTRACT

A digital speech encoder is constructed to include a short term analyzer for forming a set of prediction parameters a(i), corresponding to an input speech signal, and an encoder for producing an excitation signal. The encoder includes a plurality of serially coupled coding blocks, wherein each coding block includes an analysis filter, a sample selection block, and a synthesizer filter. The analysis filter outputs speech signal sample values to the sample selection block, which selects and outputs $K_i$ sample values representing a selected partial excitation signal. The synthesis filter synthesizes a speech signal corresponding to the selected partial excitation signal output by the selection block and outputs a partial excitation synthesis result to an output of the coding block. At the output of each coding block is a subtractor arranged for subtracting a partial excitation synthesis result that is output from the coding block from the speech signal to obtain a difference signal. The difference signal is coupled to the input of an analysis filter of a next serially coupled coding block. A quantizer is also provided for forming the excitation signal in accordance with all of the partial excitation signals generated by the coding blocks.

14 Claims, 4 Drawing Sheets

DIGITAL CODING OF SPEECH SIGNALS USING ANALYSIS FILTERING AND SYNTHESIS FILTERING

The invention relates to a method and apparatus for digital coding of speech signals at low transmission rates.

BACKGROUND OF THE INVENTION

In the last years good results have been obtained with the "analysis through synthesis" method in digital coding of a speech signal at low transmission rates. In encoders based on such analysis-synthesis methods the decoder operation is simulated already in the encoder and the synthesis result provided by each parameter combination is analyzed and the parameters representing the speech signal are selected according to which of the selectable combinations provided the best decoding result compared to the original speech signal. In the analysis-synthesis method the synthesizing parameters to be used are thus determined on the basis of the synthesized speech signal. Such a method is also called a closed system method, because the synthesis result directly controls the selection of the synthesis parameters.

In speech coding closed system search can be applied only to the most critical parameters due to the complexity of the search, e.g. to code the excitation signal in encoders using a linear prediction model. These low transmission rate speech coding methods include Multi-Pulse Excitation Coding (MPEC) and Code Excitation Linear Prediction (CELP). The realization of both the multi-pulse excitation coding and the linear code excitation coding requires an extensive calculation process and causes a high power consumption, which in practice make them difficult to realize and utilize.

With the aid of some simplifications it was recently possible to realize analysis-synthesis methods in real time using digital signal processors, but problems related to the above mentioned calculation load and the power and memory consumption make their extensive use inconvenient and in many applications prevent the use of them. Analysis-synthesis methods are explained for instance in the patent publications U.S. Pat. No. 4,472,832 and U.S. Pat. No. 4,817,157.

For an efficient coding of the excitation signal also linear predictive coding methods based on an open system have been presented, in which a part of the samples are selected directly from the analysis-filtered signal (difference signal) to be transmitted by the decoder. This method typically produces a poorer result than the feed-back method, because in this method the synthesis result is not examined at all, and the excitation sample values are not selected on the basis of the sample signal value combination providing the best synthesized signal, as is made in the above described closed system encoders. In order to obtain a low transmission rate the number of samples must be reduced or selected, and this can be made e.g. by reducing the sampling frequency of the inverse filtered signal. A method of this kind is explained e.g. in the patent publication U.S. Pat. No. 4,752,956.

The problem is to obtain good speech quality using methods where the excitation signal is selected directly from the difference signal samples. When the excitation is selected only on the basis of the difference signal, and the actual synthesis result is not used to control the formation of the excitation, then the speech signal is easily distorted during coding and its quality is lowered.

Prior art is described below with reference to the enclosed FIG. 1 showing an embodiment of the prior art solution.

FIG. 1 shows the block diagram of a prior art analysis-synthesis coding system of the CELP type. The coding in question is a code excited linear prediction coding. In the encoder the search for the excitation signal through synthesis is realized by testing all possible excitation alternatives contained in a so called code book 100, and by synthesizing in a synthesis filter 102 speech signal frames corresponding to the alternatives (in blocks of about 10 to 30 ms). The synthesized speech signal is compared with the speech signal 103 to be coded in the difference means 104, which generates a signal representing the error. The error signal can further be processed so that in the weighting block 105 some features of the human sense of hearing are taken into account in the error signal. The error calculation block 106 calculates the synthesis result obtained using each possible excitation vector contained in the code book. Thus we obtain information about the quality provided by the use of each tested excitation. The excitation vector providing the minimum error is selected to be transmitted through the control logic 101 to the decoder. To the decoder is transmitted the address of the code book memory position, where the best excitation signal contained in the code book was found.

The excitation signal used in multi-pulse excitation coding is found by a corresponding testing procedure. The procedure tests different pulse positions and amplitudes and synthesizes a speech signal corresponding to them, and further compares the synthesized speech signal with the speech signal to be coded. Contrary to the above mentioned encoder of the CELP type, the MPEC method does not examine the quality of previously formed vectors stored in the code book when the speech signal is synthesized, but the excitation vector is formed by testing different pulse positions one by one. Then we transmit to the decoder the position and the amplitude of single excitation pulses, which were selected to form the excitation.

SUMMARY OF THE INVENTION

The present invention aims to provide a method for digital coding of a speech signal, in which the above mentioned disadvantages and problems can be solved. To obtain this the invention is characterized in that the excitation signal is formed with the aid of several coding blocks, whereby in each block i sample values are selected from the signal supplied by the analysis filter $K_i$ in order to be used as partial excitation in the sample selection block, that each coding block generates with the aid of a synthesis filter a speech signal corresponding to the selected excitation, that the operation of the coding blocks is controlled by subtracting the partial excitation obtained in the preceding coding block from the speech signal to be coded before it is supplied for processing in the next coding block, and that the synthesis result obtained in each coding block is used to control the forming of the total excitation.

The present invention is a speech encoder applying linear prediction, in which the signal used as excitation is coded so that a speech signal corresponding to the formed partial excitation is synthesized in connection with the optimization of the excitation samples, whereby the optimization of the total excitation is controlled by the synthesis results of the partial excitations. The speech encoder according to the invention comprises N coding blocks performing the coding. In each coding block a set of difference signal samples to be used as partial excitation are selected, by an algorithm described below, and transmitted to the decoder (analysis step), and with the aid of the selected excitation pulses a speech signal corresponding to them is synthesized in order to be used to control the selection of the total excitation (synthesis step). The method differs from the analysis-synthesis methods in that the speech signal synthesis does not utilize all total excitation alternatives, but it is made for each partial excitation.

BRIEF DESCRIPTION OF THE DRAWINGS

Below the invention is described in detail with reference to the enclosed figures, in which

FIG. 1 was described above. The solution according to the invention is described below with reference to FIGS. 2–5 showing an embodiment of the solution according to the invention.

DETAILED DESCRIPTION OF THE INVENTION

Figure 1:
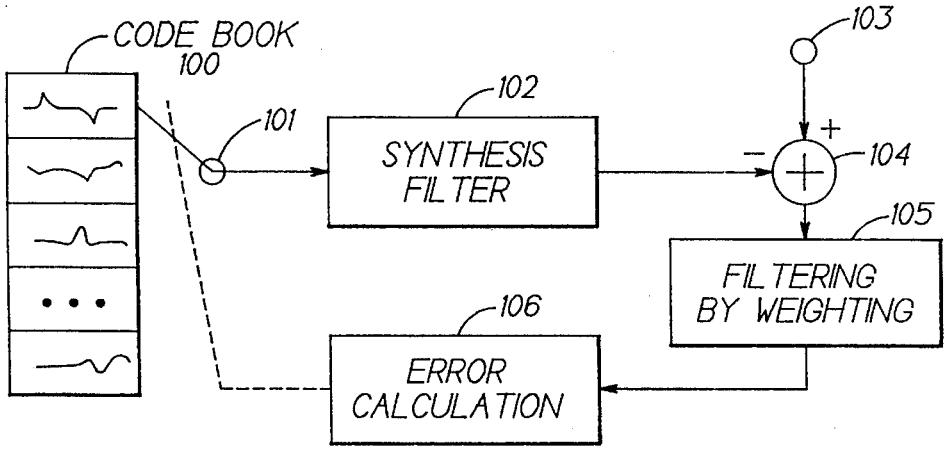
Fig. 1 Prior Art
FIG. 1 shows the block diagram of a prior art analysis-synthesis coding method of CELP type.
Figure 2A:
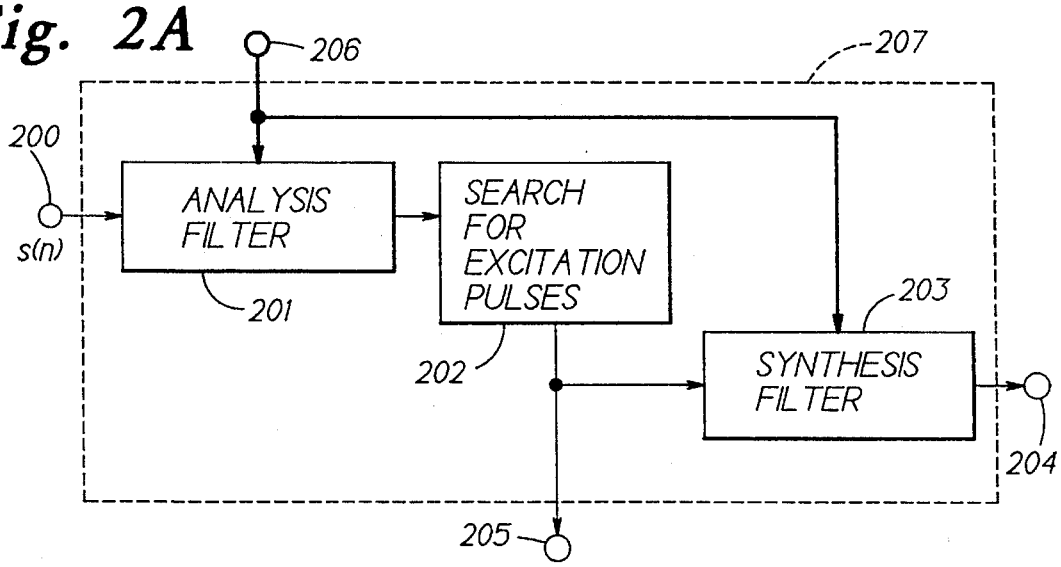
FIG. 2A shows the coding block of the encoder according to the invention.
Figure 2B:
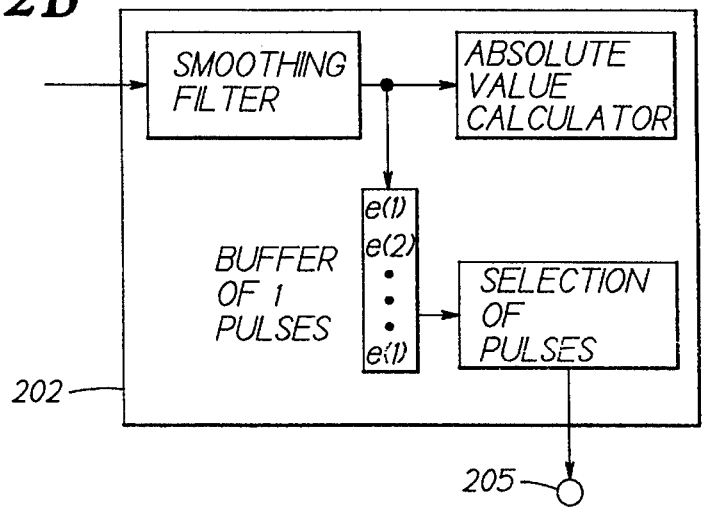
FIG. 2B shows the search block of FIG. 2A in greater detail.

FIGS. 2A and 2B show the coding block of the encoder according to the invention. The method is based on speech signal coding in coding blocks 207, so that within each coding block 207 the speech signal 200 is analysis-filtered 201, partial excitation samples are selected 202, a speech signal is synthesizes by the synthesis filter 203. Both the analysis-filtering 201 and the synthesis-filtering 203 are based on a linear filtering model, for which optimal coefficients a(1), . . . , a(M) 206 are calculated from the speech signal s(n) 200.

The analysis section performs on the speech signal an inverse filtering, whereby we obtain a difference signal or the optimal excitation signal required for the synthesis of the speech signal in the decoder's synthesis filter. Because the transmission of all sample values of the difference signal would require a high transmission capacity, the method within each speech coding block 207 in the sample selection bock 202 reduces the number of samples transmitted to the decoder by selecting in each N speech coding block $K_i$ (i=1, 2, . . . , N) pulses to be transmitted to the decoder and to be used as a partial excitation 205. The speech signal 204 formed with the aid of the $K_i$ excitation pulses selected within each coding block 207 is synthesized with the synthesis filter 203 in each coding block 207, whereby we can make out the speech signal portion synthesized by each partial excitation 205.

The analysis filter 201 (A(z) is of the form:

$$A(z)=1-_{j=1}\Sigma^{M}\ a(j)z^{-j}$$

and the synthesis filter 203 S(z) is of the form:

$$S(z)=1/A(z)$$

The analysis and synthesis filters 201, 203 further can contain also a long term filtering, which models the periodicity of voiced sounds in the speech signal.

According to the invention a speech encoder is formed by coding blocks 207 so that the speech signal 204 synthesized by the coding block 207 and obtained from the synthesis filter 203 of each coding block 207 is subtracted from the input speech signal before it is supplied to the next coding block 207. When the speech signal is coded with the aid of the coding blocks 207 it is possible to divide the coding process in two parts. On one hand the coding process in each speech block comprises an internal algorithm processing directly the difference signal and thus operating directly on the signal supplied by the analysis filter and selecting from it in each coding block 207 i in total $K_i$ excitation pulses to be used as the partial excitation 205. On the other hand the coding comprises synthesizing in the synthesis filter a speech signal 204, which corresponds to the partial excitation 205 and which is used to control the optimization of the total excitation.

Figure 3:
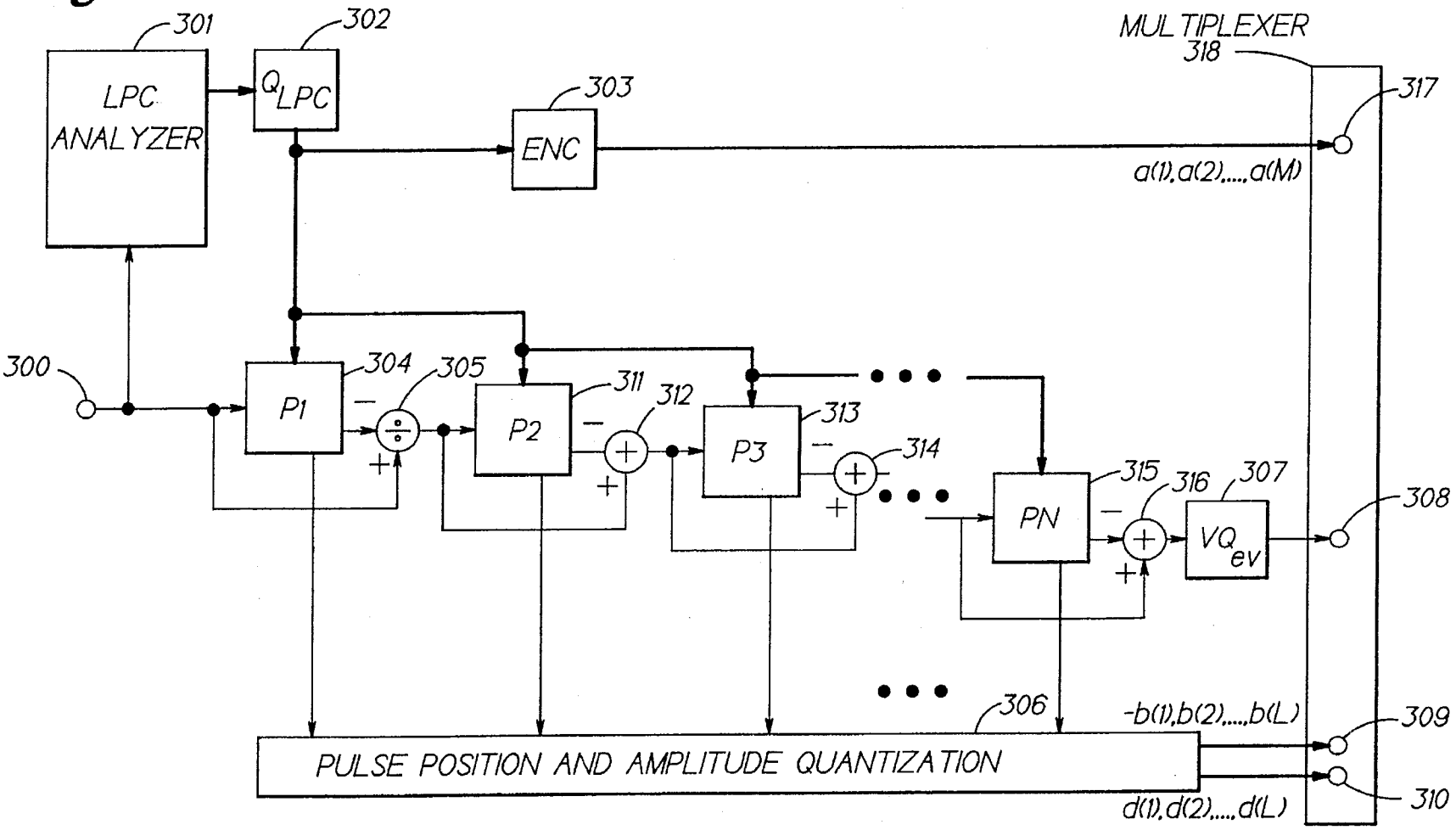
FIG. 3 shows an encoder according to the invention.

FIG. 3 shows a speech encoder according to the invention. The speech signal 300 to be coded is LPC analyzed, i.e. in the LPC analyzer 301 a linear model is calculated separately for each speech frame containing I samples and having a length of about 10 to 30 ms. The linear prediction coefficients can be calculated by any method known in the art. The prediction coefficients are quantized in the quantizing block 302 and the quantization result 317 is suitably encoded in the block 303 and then supplied to the multiplexer 318 in order to be further transmitted to the decoder. The quantized coefficients are supplied to each coding block 304, 311, 313, . . . , 315 to be used as filter coefficients by their analysis and synthesis filters.

According to the invention the coded speech signal 300 is supplied to each of the N speech coding blocks 304, 311, 313, . . . , 315 so that the effect of each partial excitation is subtracted from it in the difference means 305, 312, 314, . . . , 316. The excitation pulse positions and amplitudes defined by the partial excitations and obtained from each coding block 304, 311, 313, . . . , 315 are then transmitted to the block 306 performing the quantization and encoding to the channel and forming the total excitation's coded representation for the pulse positions b(1), . . . , b(L) 309 and for the amplitudes d(1), . . . , d(L) 310, which then are supplied to the multiplexer 318.

The synthesis filters 203 of all coding blocks use as excitations naturally quantized pulse positions and amplitudes, so that the partial excitation synthesis process in the encoder corresponds to the synthesis process in the decoder, which uses this quantized excitation. For the sake of simplicity the figures do not particularly show how the quantized excitation parameters are supplied to the coding blocks, in which they are used to form the quantized partial excitation transmitted to the synthesis filter.

When the output of the coding block 315 providing the last partial excitation is subtracted from the signal supplied to it from the preceding block we obtain the modeling error of the complete coding the from difference means 316. If desired, it is also possible to quantize and encode this signal in the vector quantizing block 307 and transmit the encoded quantizing result 308 further to the multiplexer 318.

Figure 4:
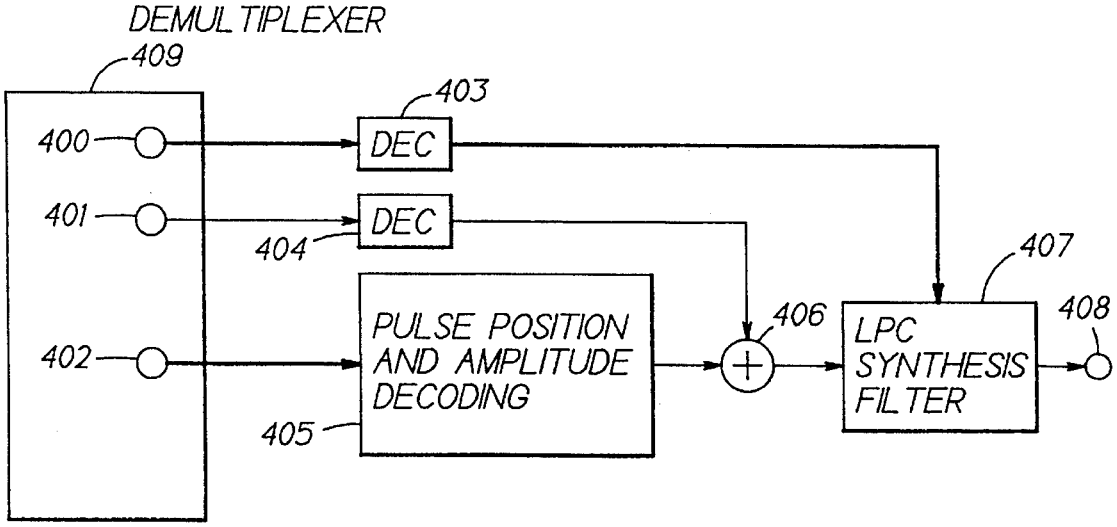
FIG. 4 shows a decoder according to the invention.

FIG. 4 shows a decoder according to the invention. The decoder demultiplexer 409 provides the coding parameters, which are supplied to the decoding blocks 403, 404, 405. An excitation signal is formed and supplied to the synthesis filter 407 in accordance with the pulse positions and amplitudes 402 from the decoding block 405. Optionally it is furthermore possible in the summing means 406 to add to the excitation an additional excitation provided by the vector decoding block 404, if the system also transmits the total prediction error 401 of the encoder modeling. The transmitted prediction coefficients 400 are decoded in block 403 and they are used in the synthesis filter 407. The synthesized speech signal 408 is obtained at the output of the synthesis filter 407.

In the encoder according to the invention we can use the below described algorithm in the search block 202 of FIG. 2B to select the excitation within each block containing I samples, whereby each coding block i (i=1, 2, . . . , N) selects as partial excitations those $K_i$ samples provided by the analysis filter 201 whose sum of absolute values is highest during the input frame to be coded, in other words the term $$|e(n_1)|+|e(n_2)|+|e(n_3)|+\ldots+|e(n_{Ki})|$$

is maximized so the distances $|n_1-n_2|$, $|n_1-n_3|$, $|n_2-n_3|$, . . . etc. between the pulses is at least N samples (i.e. the number of coding blocks used in the encoder). In the term to be maximized the factor e(k) (k=1, 2, . . . , I) is the output from the analysis filter 201, i.e. the difference signal of the linear modeling. From this sequence containing I samples we thus select by the above mentioned algorithm $K_i$ pulses to be used as the partial excitation. The total excitation is obtained as the sum of the partial excitations.

The algorithm for the search of the excitation pulses can be improved so that a filtering of low-pass type is added to it, whereby the difference signal is filtered before the term to be maximized is calculated. The frequency response of the applied low-pass filter observes the average distribution of the speech into different frequencies.

Figure 5:
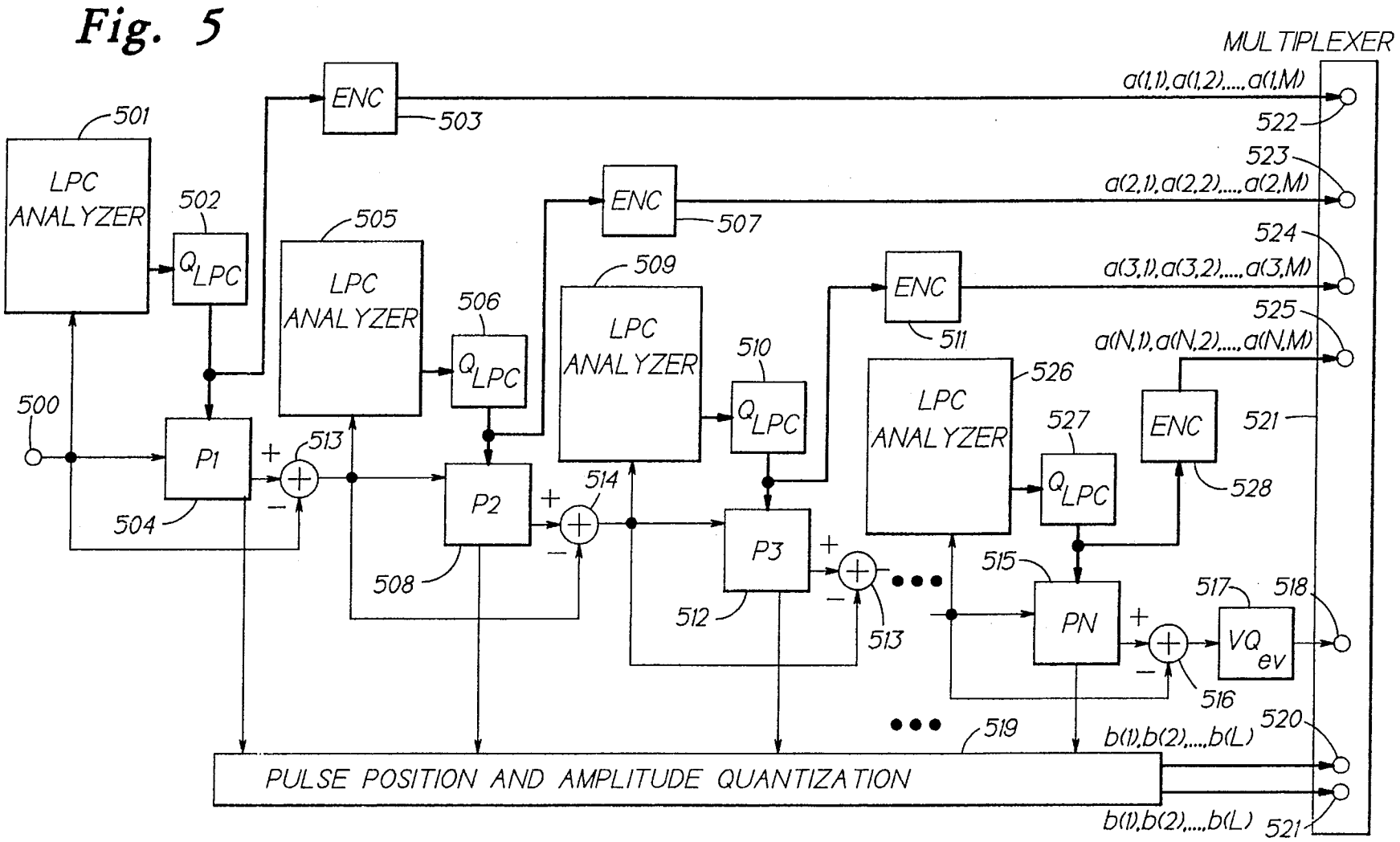
FIG. 5 shows an alternative embodiment of the encoder according to the invention.

FIG. 5 shows an alternative embodiment of the speech encoder according to the invention. The alternative embodiment differs from the embodiment shown in FIG. 3 in that more filtering coefficients are calculated for the signal to be coded. In this embodiment each partial excitation is combined in a filter providing a different frequency response, whereby each coding block 504, 508, 512, . . . contains analysis and synthesis filters that use coefficients, which are calculated to correspond to the signal supplied to the respective coding block 504, 508, 512.

Thus each partial excitation through a different synthesis filter synthesizes its share of the speech signal. The decoder correspondingly used N parallel synthesis filters, each of them receiving a corresponding decoded partial excitation, and the synthesized speech signal is obtained as the sum of signals synthesized by the partial excitations.

Through the use of the invention we avoid the extensive computation process and high power consumption required in a closed system. Moreover, this method has an insignificant memory consumption. In an encoder according to the invention we can use comparatively simple excitation selection algorithms like the above described algorithms, and still obtain a high speech quality without the need for methods employing a complex and have calculation step for all possible total excitations.

In view of the foregoing description it will be evident to a person skilled in the art that various modifications may be made within the scope of the invention.

The scope of the present disclosure includes any novel feature or combination of features disclosed therein either explicitly or implicitly or any generalisation thereof irrespective of whether of not it relates to the claimed invention or mitigates any or all of the problems addressed by the present invention. The application hereby gives notice that new claims may be formulated to such features during the prosecution of this application or any such further application derived therefrom.

What we claim is:

1. An encoder comprising at least one coding block, said at least one coding block comprising:

filter means for forming excitation signals corresponding to a first signal input to the filter means, selection means for selecting from the excitation signals, and in accordance with predetermined criteria, a set of partial excitation signals, and synthesis means for forming a second signal corresponding to the et of partial excitation signals.

2. An encoder according to claim 1, further comprising a subtracting means for subtracting the second signal from the first signal thereby forming a third signal, said subtracting means having an output coupled to an input of a filter means of a second coding block.

3. A speech encoder utilizing linear prediction in which excitation signals are coded such that a speech signal corresponding to partial excitation signals formed from the excitation signals is synthesized in connection with optimizing excitation samples, and whereby total excitation signals are generated in accordance with the speech signals synthesized from the partial excitation signals.

4. A method for performing digital speech coding, comprising the steps of:

forming, in a short term analyzer, a set of prediction parameters a(i) corresponding to an input speech signal, the prediction parameters being formed so as to characterize a short term spectrum of the input speech signal;

producing an excitation signal in an encoder comprised of a plurality of serially coupled coding blocks each having an analysis filter, a sample selection block, and a synthesis filter, the excitation signal comprising a number of samples and enabling a synthesis of a speech signal corresponding to the input speech signal when the excitation signal is used in conjunction with the prediction parameters; wherein in a first coding block the analysis filter has an input for receiving the speech signal and in each coding block following the first coding block the analysis filter has an input for receiving a modified speech signal from which at least one partial excitation signal has been removed, each analysis filter further having an output for outputting speech signal sample values to the sample selection block, wherein the sample selection block selects $K_i$ sample values representing a selected partial excitation signal;

in each coding block, forming in the synthesis filter a synthesized speech signal corresponding to the selected partial excitation signal, the synthesis filter having an output providing a partial excitation synthesis result to an output of the coding block;

the method further including the steps of subtracting from the speech signal, for the first coding block, a partial excitation synthesis result that is output from the first coding block to generate a difference signal, and for each coding block following the first coding block, subtracting the partial excitation synthesis result that is output from the coding block from the difference signal that is generated for a previous coding block to obtain the difference signal; and supplying the difference signal as a modified speech signal to the input of the analysis filter of a next serially coupled coding block; wherein the selected partial excitation signal obtained in each of the plurality of coding blocks is used in forming the excitation signal.

5. A method according to claim 4, wherein pulses that comprise the excitation signal are formed in each coding block so that they have a maximum sum of their absolute values, wherein the samples are situated at least at a distance N from each other, and wherein N is a number of coding blocks that comprise the encoder.

6. A method according to claim 5, wherein prior to the selection of excitation pulses the samples obtained from the analysis filter are filtered with a filter whose frequency response corresponds to an average frequency distribution of the input speech signal.

7. A method according to claim 6, wherein the prediction parameters a(i) are calculated to replace an original speech signal and to individually correspond to the speech signal supplied to individual ones of the plurality of coding blocks, from which speech signal is subtracted the synthesized speech signal corresponding to the partial excitation signals, whereby each partial excitation signal is associated with one of a plurality of synthesis filters, which may have different frequency behaviors.

8. A digital speech encoder, comprising:

an analyzer for forming a set of prediction parameters a(i) corresponding to an input speech signal;

an encoder for producing an excitation signal, said encoder being comprised of a plurality of serially coupled coding blocks each of which is comprised of an analysis filter, a sample selection block, and a synthesis filter, the excitation signal comprising a number of speech samples and enabling a synthesis of a speech signal corresponding to the input speech signal when the excitation signal is used in conjunction with the prediction parameters; wherein in a first coding block of the serially coupled coding blocks the analysis filter has an input for receiving the speech signal and in each coding block following the first coding block the analysis filter has an input for receiving a modified speech signal from which at least one partial excitation signal has been removed, each analysis filter further having an output for outputting speech signal sample values to the sample selection block, wherein the sample selection block selects $K_i$ sample values representing a selected partial excitation signal; wherein the synthesis filter synthesizes a speech signal corresponding to the selected partial excitation signal output by the sample selection block, the synthesis filter having an output providing a partial excitation synthesis result to an output of the coding block;

said digital speech encoder further comprising:

means for subtracting from the speech signal, for the first coding block, a partial excitation synthesis result that is output from the first coding block to generate a difference signal, and for each coding block following the first coding block, means for subtracting the partial excitation synthesis result that is output from the coding block from the difference signal that is generated for a previous coding block to obtain the difference signal, each of said subtracting means having an output for supplying the difference signal as a modified speech signal to the input of the analysis filter of a next serially coupled coding block; and means, having inputs coupled to outputs of individual ones of said sample selection blocks of each of said plurality of coding blocks, for forming the excitation signal in accordance with the partial excitation signals.

9. A digital speech encoder as defined in claim 8, wherein a plurality of prediction parameters are calculated for the speech signal, wherein each partial excitation signal is combined in a filter realizing a different frequency response such that each coding block comprises an analysis filter and a synthesis filter using filter coefficients which are calculated to correspond to the speech signal inputted to the respective coding block, wherein a decoder correspondingly uses a plurality of parallel synthesis filters, each of which is supplied with a corresponding decoded partial excitation signal, and wherein a synthesized speech signal is obtained as a sum of the signal synthesized by the partial excitation signals.

10. A speech encoder, comprising:

an LPC analyzer having an input coupled to a speech signal, said LPC analyzer having an output providing linear prediction coefficients;

a quantizer coupled to said output of said LPC analyzer for outputting quantized linear prediction coefficients;

an encoder coupled to an output of said quantizer for outputting encoded quantized linear prediction coefficients;

a plurality of serially coupled speech coding blocks each comprising an analysis filter, a sample selection block, and a synthesis filter, individual ones of said plurality of speech coding blocks being coupled to an output of said quantizer for receiving quantized linear prediction coefficients therefrom for use as filter coefficients for said analysis filter and said synthesis filter, wherein in a first speech coding block of the serially coupled speech coding blocks the analysis filter has an input for receiving the speech signal and in each speech coding block following the first speech coding block the analysis filter has an input for receiving a modified speech signal from which at least one partial excitation signal has been removed, each analysis filter further having an output for outputting speech signal sample values to said sample selection block, wherein said sample selection block selects and outputs $K_i$ sample values representing a selected partial excitation signal, and wherein said synthesis filter synthesizes a speech signal corresponding to the selected partial excitation signal output by said selection block, said synthesis filter having an output providing a partial excitation synthesis result to an output of the speech coding block;

a plurality of difference means individual ones of which are coupled to said output of each of said speech coding blocks, wherein a difference means that is coupled to the output of said fist speech coding block subtracts a partial excitation synthesis result that is output from the first speech coding block from the speech signal to generate a difference signal, and for each speech coding block following the first speech coding block, said difference means subtracts the partial excitation synthesis result that is output from the speech coding block from the difference signal that is generated for a previous, adjacent speech coding block to obtain the difference signal; and a pulse position and amplitude quantizer having a plurality of inputs individual ones of which are coupled to an output of one of said sample selection blocks, said pulse position and amplitude quantizer generating an excitation signal for use with the encoded quantized linear prediction coefficients, wherein pulse positions and amplitudes of excitation pulses corresponding to the partial excitation signal output from each speech coding block are formed into a representation of the pulse positions and the pulse amplitudes of the excitation signal in said pulse position and amplitude quantizer.

11. A speech encoder as defined in claim 10, and further comprising a vector quantizer having an input coupled to an output of a difference means that is coupled to an output of a last serially coupled speech coding block.

12. A speech encoder as set forth in claim 11, and further comprising a digital speech decoder comprising decoding blocks operating to determine pulse positions and amplitudes and a decoded excitation signal; a synthesis filter for forming a synthesized speech signal in accordance with the determined pulse positions and amplitudes and decoded prediction coefficients, said decoder being further responsive to an additional excitation provided by a decoding of an output of said vector quantizer.

13. A speech encoder as defined in claim 10, wherein said analysis filter A(z) of each speech coding block is of the form:

$$A(z)=1-_{j=1}\Sigma^{M} a(j)\, z^{-j},$$

and said synthesis filter S(z) of each speech coding block is of the form:

$$S(z)=1/A(z).$$

14. A speech encoder as defined in claim 10, wherein each said speech coding block further comprises a filter means which models a periodicity of voiced sounds in a speech signal.

* * * * *